US010501308B2

(12) United States Patent
Song

(10) Patent No.: US 10,501,308 B2
(45) Date of Patent: Dec. 10, 2019

(54) BEVERAGE FEEDER AND BEVERAGE FEEDER ASSEMBLY

(71) Applicant: NPC CO., LTD., Ansan-si, Gyeonggi-do (KR)

(72) Inventor: In Hwan Song, Yongin-si (KR)

(73) Assignee: NPC CO., LTD., Ansan-si, Gyeonggi-do (KR)

( * ) Notice: Subject to any disclaimer, the term of this patent is extended or adjusted under 35 U.S.C. 154(b) by 79 days.

(21) Appl. No.: 15/573,449

(22) PCT Filed: May 2, 2016

(86) PCT No.: PCT/KR2016/004626
§ 371 (c)(1),
(2) Date: Nov. 10, 2017

(87) PCT Pub. No.: WO2016/182245
PCT Pub. Date: Nov. 17, 2016

(65) Prior Publication Data

US 2018/0141799 A1 May 24, 2018

(30) Foreign Application Priority Data

May 12, 2015 (KR) ..... 10-2015-0065776

(51) Int. Cl.
*B67D 1/12* (2006.01)
*B67D 3/00* (2006.01)
(Continued)

(52) U.S. Cl.
CPC ..... *B67D 1/1272* (2013.01); *A47G 19/22* (2013.01); *A47G 19/2205* (2013.01);
(Continued)

(58) Field of Classification Search
CPC ..... B65D 1/06; B67D 1/1272; B67D 1/06; A47G 19/1272
(Continued)

(56) References Cited

U.S. PATENT DOCUMENTS 5,556,005 A 9/1996 Banks
5,653,270 A * 8/1997 Burrows ..... B67D 3/0032 141/18
8,763,655 B2 * 7/2014 Springer ..... A47G 19/2205 141/113
(Continued)

FOREIGN PATENT DOCUMENTS

JP H10511878 11/1998
JP 2013520376 6/2013
(Continued)

OTHER PUBLICATIONS

Korean Patent Office, Office Action for Application No. 10-2015-00065776, dated Jan. 20, 2016, 6 pages.
(Continued)

*Primary Examiner* — Timothy P. Kelly
(74) *Attorney, Agent, or Firm* — Sustein Kann Murphy & Timbers LLP

(57) ABSTRACT

The present invention relates to a beverage feeder and, particularly, to a beverage feeder in which a sealing member is disposed at a part lower than a discharge part of a nozzle, and the sealing member is disposed at the lower part of a beverage container so as to easily fit or separate the beverage container to/from the nozzle and, simultaneously, enable effective sealing.

4 Claims, 14 Drawing Sheets

(51) Int. Cl.

| | |
|---|---|
| ***A47G 19/22*** | (2006.01) |
| ***B65D 1/06*** | (2006.01) |
| ***B67D 1/08*** | (2006.01) |

(52) U.S. Cl.
CPC ..... *A47G 19/2233* (2013.01); *B65D 1/06* (2013.01); *B67D 1/0894* (2013.01); *B67D 3/0058* (2013.01); *A47G 19/2255* (2013.01); *B67D 1/0805* (2013.01); *B67D 2210/00065* (2013.01)

(58) Field of Classification Search
USPC ..... 141/113
See application file for complete search history.

(56) References Cited

U.S. PATENT DOCUMENTS

| | | | | |
|---|---|---|---|---|
| 8,997,803 | B2 | 4/2015 | Fallon et al. | |
| 9,016,333 | B2 * | 4/2015 | Shaffer | B65D 1/04 141/113 |
| 9,957,149 | B2 * | 5/2018 | Park | B67D 1/1272 |
| 2014/0182744 | A1 | 7/2014 | Shaffer | |
| 2015/0047741 | A1 * | 2/2015 | Wong | A45D 34/00 141/113 |

FOREIGN PATENT DOCUMENTS

| | | |
|---|---|---|
| JP | 2014180438 | 9/2014 |
| KR | 20120065298 | 6/2012 |
| KR | 10-1243382 | 3/2013 |
| KR | 101333154 | 11/2013 |
| KR | 10-1428334 | 8/2014 |
| KR | 10-1487078 | 1/2015 |
| KR | 10-1498251 | 3/2015 |
| WO | WO 2006/055866 A1 | 5/2006 |

OTHER PUBLICATIONS

Korean Patent Office, Final Office Action for Application No. 10-2015-00065776, dated Jul. 23, 2016, 9 pages.

You Tube; Chrome, You Tube; Chrome—Reverse Tap Web Engine Search, 1 page.

Chinese Patent Office, First Office Action, Application No. 201680027577.9, dated Nov. 2, 2018, 9 pages (with English translation).

European Patent Office, Extended European Search Report, Application No. 16792891.0, dated Nov. 6, 2018, 7 pages.

* cited by examiner

BEVERAGE FEEDER AND BEVERAGE FEEDER ASSEMBLY

BACKGROUND

1. Technical Field

The present invention relates to a beverage feeder, and particularly to a beverage feeder in which a sealing member is disposed below a discharge part of a nozzle, and the sealing member is disposed below a beverage container.

2. Description of Related Art

A beer glass, which is one example of a generally used container accommodating a beverage which foams, is formed of transparent glass or a transparent synthetic resin, and since a relatively large amount of beer is poured and drunk at one time, a beer glass into which 500 cc or 1,000 cc of beer can be poured and drunk is conventionally widely used.

A conventional beer glass is formed such that a bottom thereof is blocked, an upper portion thereof is open, and a beverage is injected thereinto through the upper opening.

Since a large amount of foam of draft beer which is poured by a beverage feeder is generated in comparison to other beverage due to an injection pressure as the beer is poured through the opening of the upper portion of the container, there is a hassle in removing the foam after the beverage is poured into the container such as a beer glass.

Accordingly, when draft beer is poured into a beverage container through an existing draft beer feeder and a temperature thereof is not appropriate, there are problems in that a large amount of foam is generated, overflows, and wets a cloth because the beer is poured from above, the wet cloth is not good for hygiene, and a taste of the draft beer is reduced due to too much foam.

In addition, the conventional beer glass has a problem in that, when beer is poured thereinto, the beer is oxidized due to contact with air and a taste thereof is reduced, and such a phenomenon more strongly occurs in a case in which draft beer is drunk.

Then, in a case in which draft beer is injected into a beverage container through a hole formed in a lower surface thereof to remove such a problem, foam of the draft beer can be properly maintained, but there is a problem in that, when this method is applied, the above-described method cannot be adopted because there is no appropriate method of closing the hole after the draft beer is injected into the beverage container through the bottom hole.

Accordingly, there is a need for a beverage container capable of improving the above-described problem.

Korean Patent Registration No. 10-1243382 (Mar. 23, 2013), "Device for Blocking Inlet of Beverage Cup and Manufacture Method for the Same" (hereinafter, referred to as related art 1) is known as a related art for solving the above problems, and related art 1 includes an inlet formed to pass from an inner side to an outer side of a bottom of a beverage cup and configured to inject a beverage into the beverage cup through a nozzle of a beverage feeder, and magnetic blocking parts provided on outer and inner surfaces of the bottom of the beverage cup and attached thereto to close the inlet after the beverage is forcibly injected thereinto though the nozzle of the beverage feeder.

Related art 1 prevents leakage of the beverage to the outside by closing the inlet using a magnetic force of the magnetic blocking parts when the beverage is completely injected in a state in which the inlet is open.

However, in related art 1, since the magnetic blocking parts formed of a metal material having a magnetic force are used, the beverage easily comes into contact with the magnetic blocking parts, and such contact has a great risk of spoiling the beverage due to a beverage cup being rusted when the beverage cup is used for a long period of time, and thus the beverage cup has a problem in that hygiene management thereof is poor as a beverage container through which a user directly drinks a beverage and effectiveness is poor as a beverage container harmless to the human body.

Particularly, in the case of related art 1, since a sealing technology is needed to prevent direct contact of the magnetic blocking parts with a beverage, such a manufacturing method is unreasonable in view of ease of manufacturing the beverage cup, and since a manufacturing cost rises, there is a limit in popularizing the beverage cup as a low-cost consumer good.

In addition, in Japanese Laid-Open Patent Application No. 2014-180438 (hereinafter, referred to as related art 2), an inlet is formed on a side surface of a container such that an injected liquid flows therein in a swirl. However, in related art 2, since the inlet is formed in the side surface of the container, there are problems in that molding of the container is difficult due to a complex structure thereof and it is difficult to connect the inlet and a beverage feeder.

To solve the problems of such related arts, a beverage container including a holder configured to open and close an inlet and a locking member configured to elastically support the holder has been proposed. However, in such a beverage container, since a sealing member is interposed between a sidewall of a nozzle and an inner wall of the holder, friction and a tightly-fitting phenomenon occur due to the sealing member when the beverage container is fitted to and detached from the nozzle, and thus there is a problem in that fitting and detaching are difficult.

SUMMARY

1. Technical Problem

A technical objective of the present invention is to provide a beverage feeder capable of easily fitting a beverage container to a nozzle or separating the beverage container from the nozzle, and effectively performing sealing.

2. Solution to Problem

A beverage feeder according to the present invention comprises: a nozzle inserted into an inlet formed in a bottom surface of a beverage container, wherein: a sealing member is installed on an outer circumferential surface of the nozzle; the sealing member is disposed below a discharge part of the nozzle; and the sealing member is disposed below the beverage container.

The sealing member may be disposed below a holder of the beverage container, the nozzle may include a diameter decreasing part and a diameter increasing part disposed below the diameter decreasing part, and the sealing member may be interposed between the diameter decreasing part and the diameter increasing part.

A tapered part may be formed at an upper portion of the nozzle such that an outer diameter of the tapered part decreases toward an upper portion of the tapered part.

An upper edge of the nozzle may be formed to be round.

A beverage feeder assembly according to the present invention comprises: a beverage container in which an inlet is formed in a bottom surface thereof and a beverage feeder including a nozzle inserted into the inlet, wherein: a sealing member is interposed between a lower surface of the beverage container and the beverage feeder; and the sealing member is disposed below a discharge part of the nozzle.

3. Advantageous Effects

According to the above-described beverage feeder of the present invention, there are the following advantageous effects.

Since a sealing member is disposed below a discharge part of a nozzle and disposed below a beverage container, the beverage container can be easily fitted to or separated from the nozzle while also allowing sealing to be effectively performed.

Since the sealing member is disposed below a holder of the beverage container, sealing can be more effectively performed.

Since the nozzle includes a diameter decreasing part and a diameter increasing part disposed below the diameter decreasing part and the sealing member is interposed between the diameter decreasing part and the diameter increasing part, the sealing member can be stably installed.

Since a tapered part is formed at an upper portion of the nozzle such that an outer diameter thereof decreases toward an upper portion of the tapered part or an upper edge of the nozzle is formed to be round, a beverage container can be easily fitted to or separated from the nozzle even in a state in which the beverage container is not in vertically oriented but is slightly tilted.

DETAILED DESCRIPTION OF EMBODIMENTS

Figure 1:
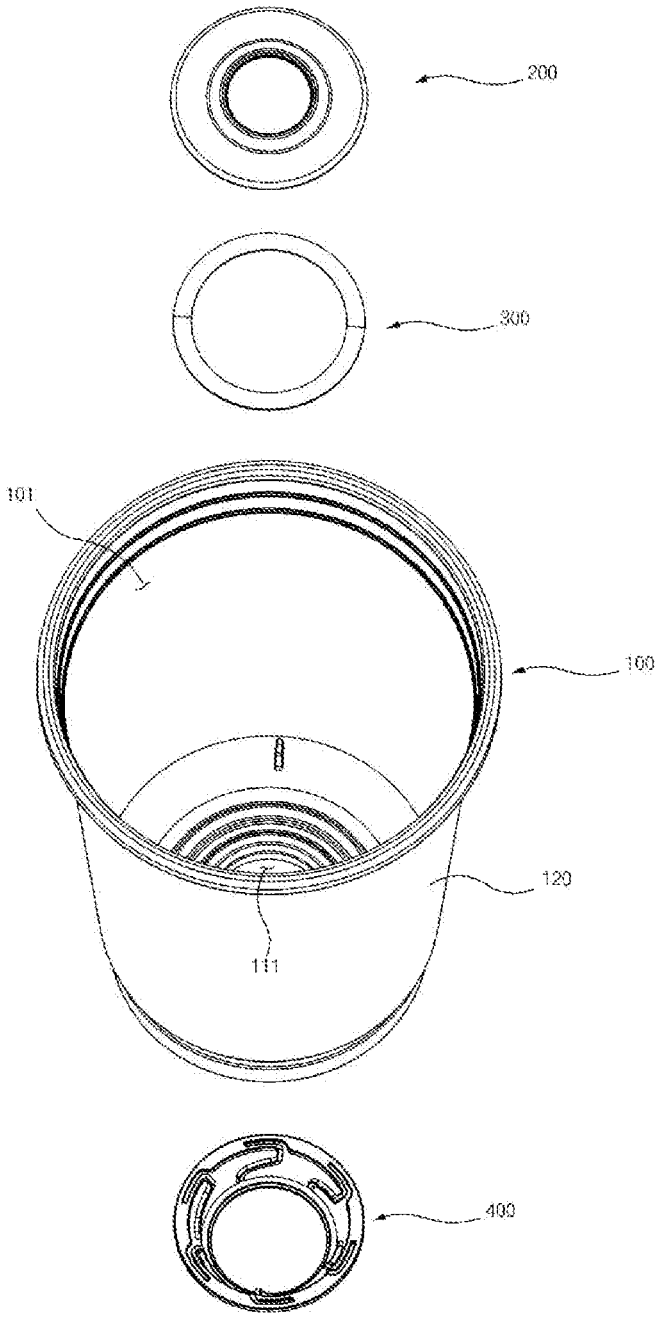
FIG. 1 is an exploded perspective view illustrating a beverage container according to an exemplary embodiment of the present invention.

Hereinafter, an exemplary embodiment of the present invention will be described below in detail with reference to accompanying drawings.

For reference, elements of the present invention, which will be described below, identical to those of the prior art refer to the above-described prior art, and additional detailed descriptions thereof will be omitted.

As illustrated in FIGS. 1 to 17, a beverage feeder assembly of the present embodiment includes a beverage container in which an inlet 111 is formed in a bottom surface 110 and a beverage feeder 500 including a nozzle 540 inserted into the inlet 111.

The beverage container of the present embodiment includes the bottom surface 110 in which the inlet 111 is formed, a container body 100 including a sidewall 120 configured to surround the bottom surface 110, a holder 200 installed at the inlet 111 to be slidable on the container body 100 and configured to open and close the inlet 111, and a locking member 400 interposed between the holder 200 and the container body 100 and configured to elastically support the holder 200 in a direction in which the inlet 111 is closed, and the locking member 400 includes a first member 410, a second member 430 disposed to be spaced apart from the first member 410, and an elastic arm 420 configured to connect the first member 410 and the second member 430 and be elastically deformed.

The container body 100 is formed in a cup shape having an open upper portion.

Figure 2:
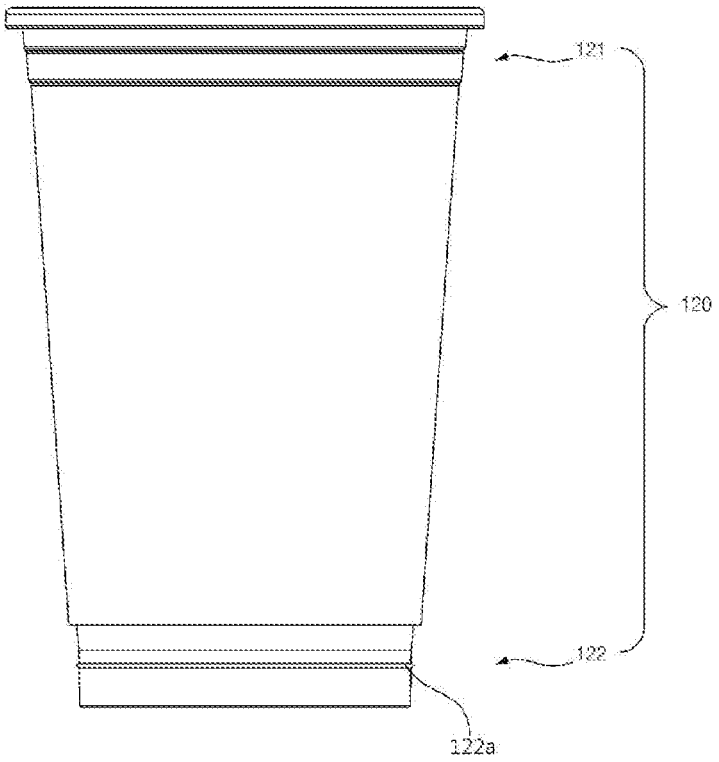
FIG. 2 is a side view illustrating the beverage container according to the exemplary embodiment of the present invention
Figure 3:
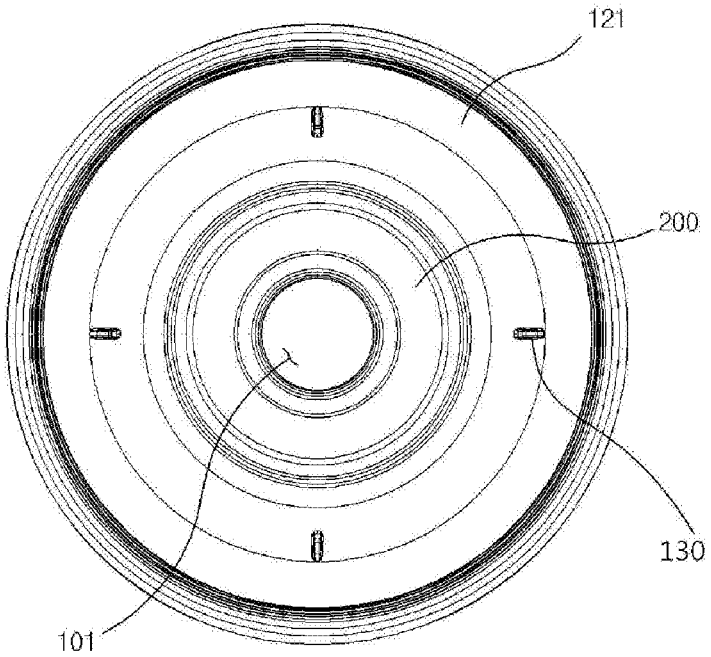
FIG. 3 is a plan view illustrating the beverage container according to the exemplary embodiment of the present invention.
Figure 4:
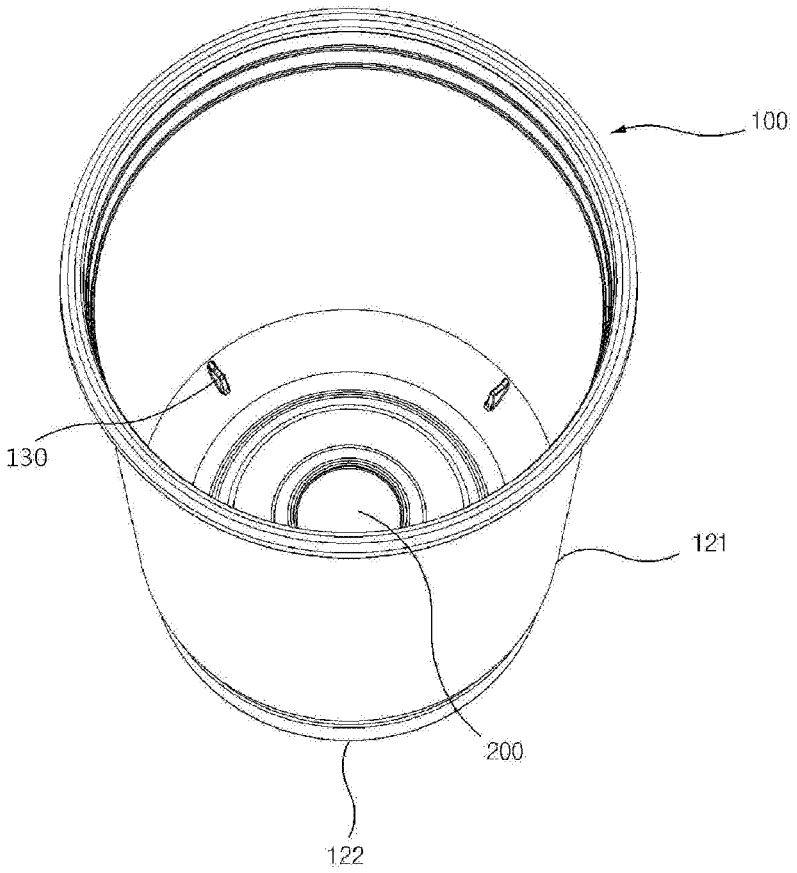
FIG. 4 is a perspective view illustrating the beverage container according to the exemplary embodiment of the present invention.

As illustrated in FIGS. 2 and 3, the sidewall 120 includes a first sidewall 121 disposed above the bottom surface 110 and a second sidewall 122 disposed below the bottom surface 110.

The first sidewall 121 is formed to be tapered such that inner and outer diameters thereof increase toward an upper portion thereof. A flange is formed at an upper end of the first sidewall 121, a first step part is formed below the flange, and a second step part is formed below the first step part. A recessed circumferential groove is formed in a lower end of the first sidewall 121 along a circumference thereof. An inner sidewall of the recessed circumferential groove is formed to be continued to an upper end of the second sidewall 122.

An accommodation part 101 surrounded by the bottom surface 110 and the first sidewall 121 is formed in the container body 100.

The second sidewall 122 is formed to be tapered such that an outer diameter thereof increases toward an upper portion of the second sidewall 122. A stopping protrusion 122*a* configured to be hooked to the beverage injector 500, which will be described below, is formed on an outer circumferential surface of a central portion of the second sidewall 122.

The stopping protrusion 122*a* is formed in a ring shape such that both ends thereof are connected to each other.

A shape of a vertical cross-section of the stopping protrusion 122*a* is formed to be bent to have a semicircular shape.

On the other hand, a stopping groove to which a stopping protrusion formed at the beverage injector 500 is hooked may also be formed in the second sidewall 122.

That is, the stopping protrusion may be formed on one of the outer circumferential surface and the beverage feeder 500 of the beverage container, and the stopping groove to which the stopping protrusion is hooked may be formed in the other one of the two.

Ribs 130 are formed to upwardly protrude from an upper surface of a portion configured to connect the bottom surface 110 and the sidewall 120. The ribs 130 are formed linearly in a radial direction. The ribs 130 may improve durability of the beverage container. In addition, when beverage containers are stacked and stored, the ribs 130 may serve as a stopper such that the containers are not trapped in each other.

The ribs 130 are disposed inside the container body 100.

The ribs 130 are integrally formed with the container body 100.

The ribs 130 are formed in a plate shape and formed to be perpendicular to the bottom surface 110.

A bent part 123 is formed at a surface on which the ribs 130 are formed in the container body 100.

That is, the bent part 123 is formed at the portion configured to connect the bottom surface 110 and the sidewall 120.

Meanwhile, a reinforcing rib 124 is formed to protrude from an upper portion inside the second sidewall 122. An upper portion of the reinforcing rib 124 is connected to a lower surface of the bottom surface 110.

Figure 5A:
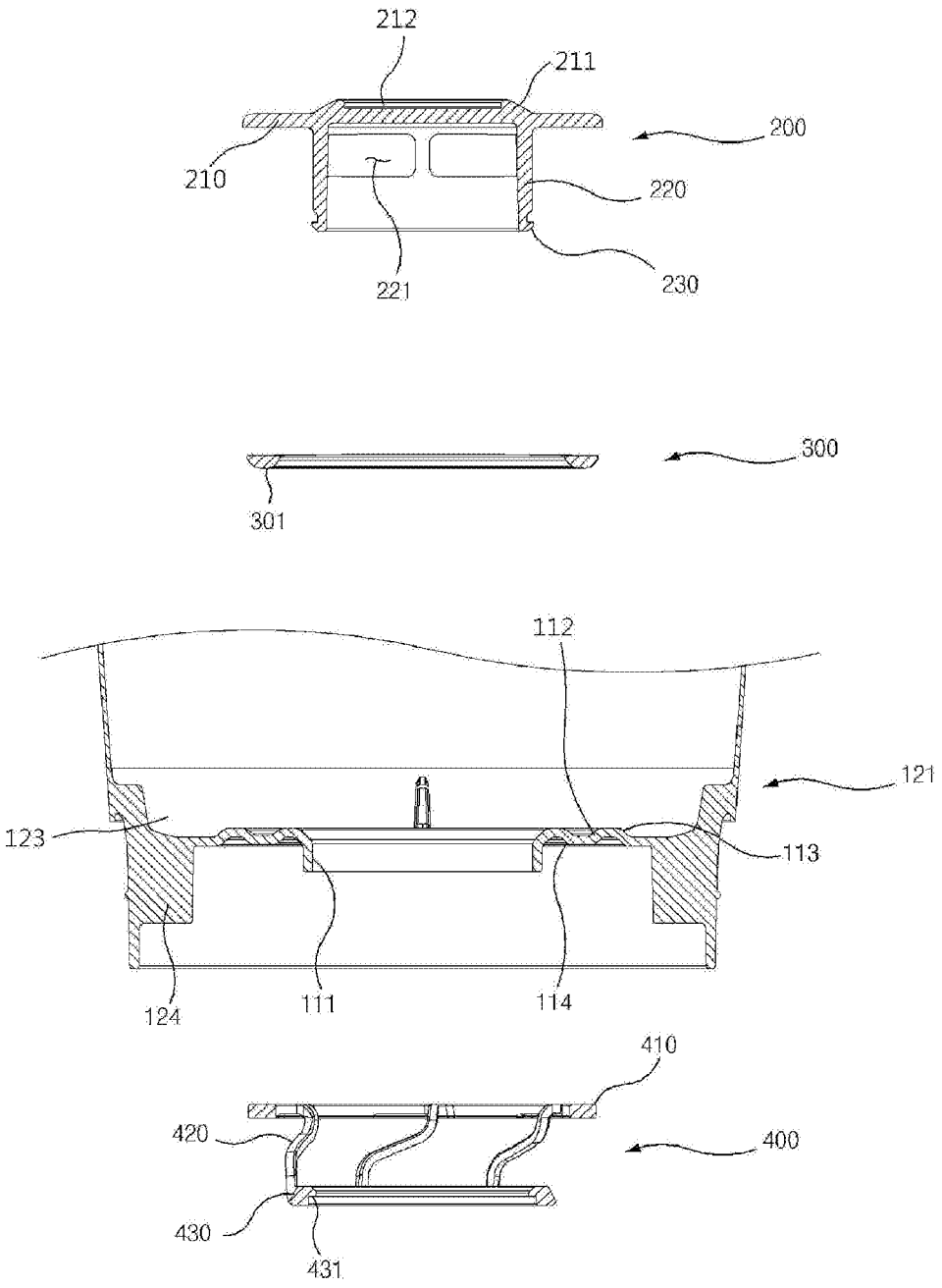
FIG. 5*a* is an exploded cross-sectional view illustrating a main portion of the beverage container according to the exemplary embodiment of the present invention
Figure 5B:
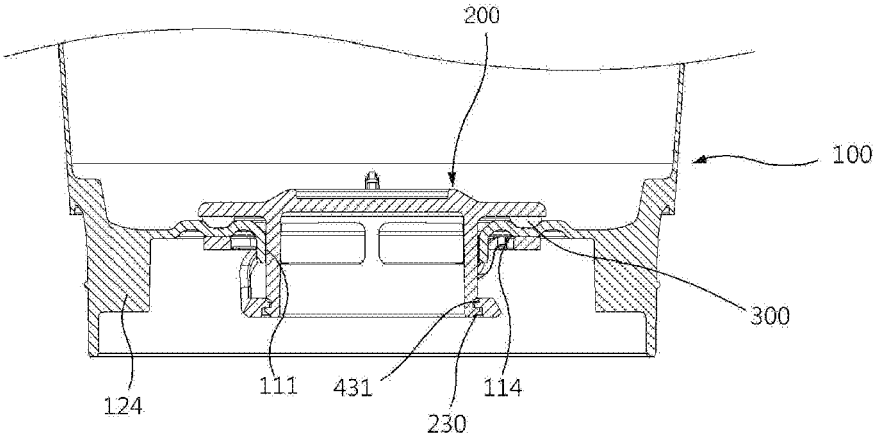
FIG. 5*b* is a coupling cross-sectional view of FIG. 5*a*.
Figure 6:
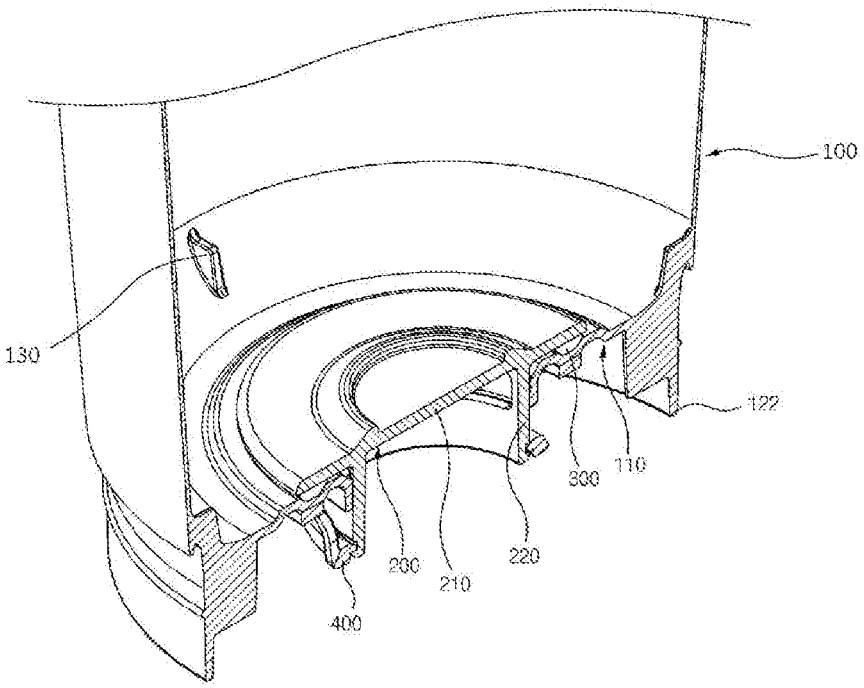
FIG. 6 is a cross-sectional perspective view of FIG. 5*b*.
Figure 7:
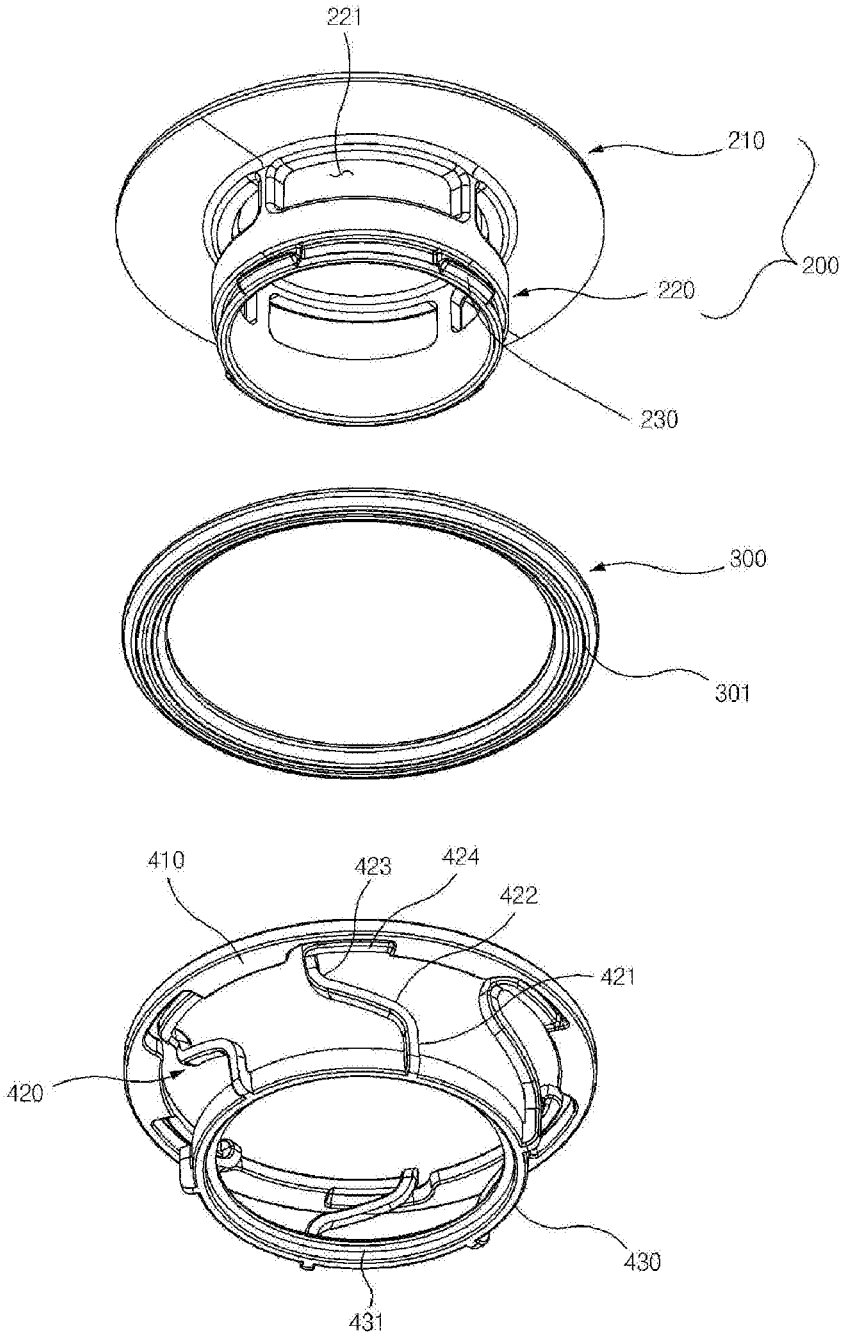
FIG. 7 is an exploded perspective view illustrating a holder, a packing member, and a locking member of the beverage container according to the exemplary embodiment of the present invention.
Figure 8:
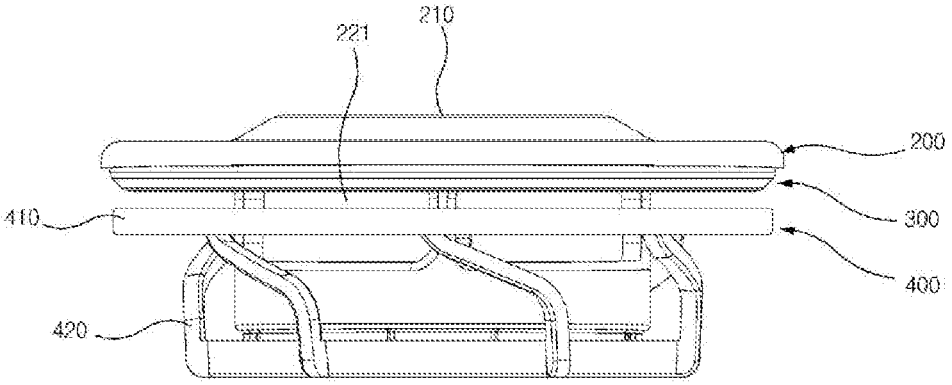
FIG. 8 is a coupling view of FIG. 7.
Figure 9:
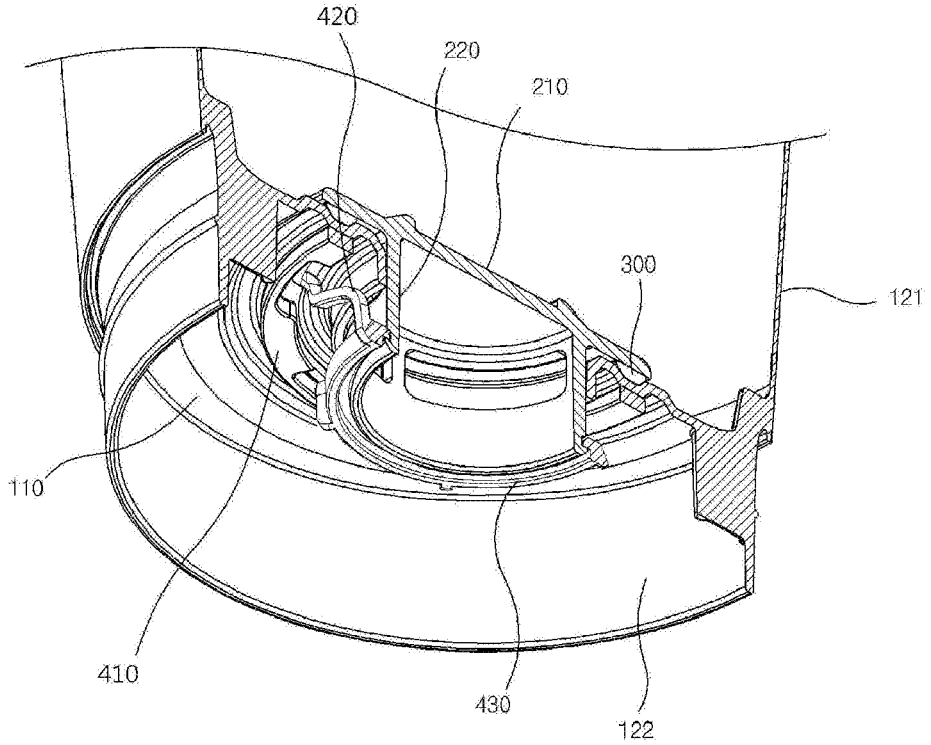
FIG. 9 is a cross-sectional perspective view illustrating a lower portion illustrated in FIG. 5*b*.
Figure 10:
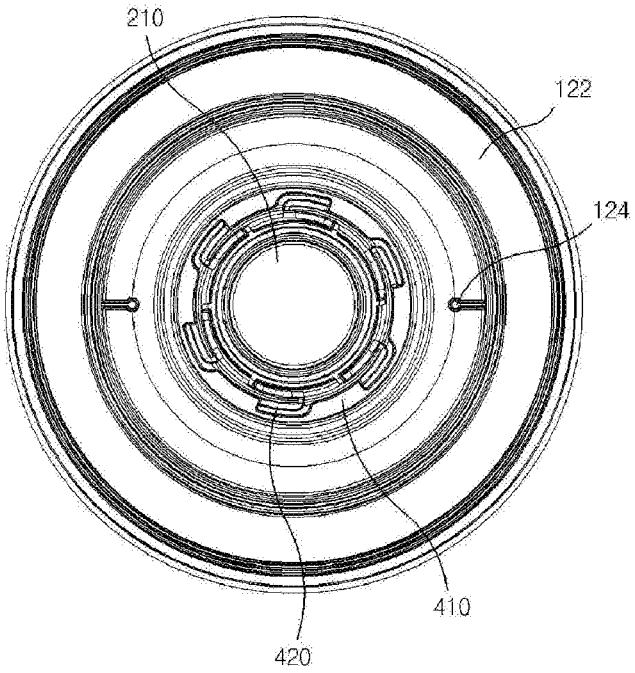
FIG. 10 is a bottom view illustrating the beverage container according to the exemplary embodiment of the present invention.
Figure 11:
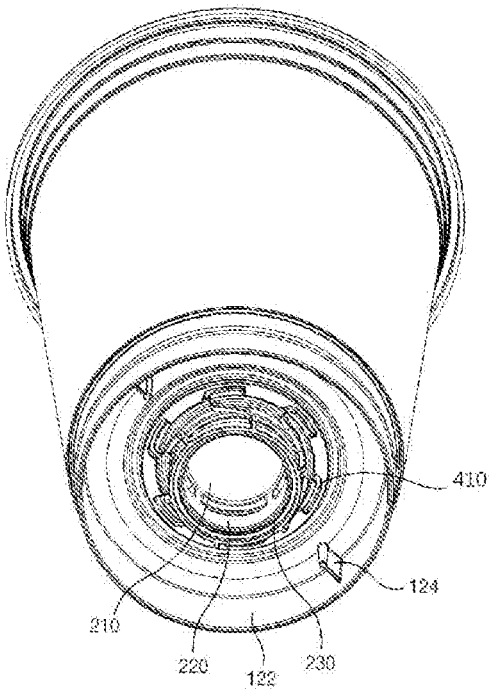
FIG. 11 is a perspective bottom view illustrating the beverage container according to the exemplary embodiment of the present invention.
Figure 12:
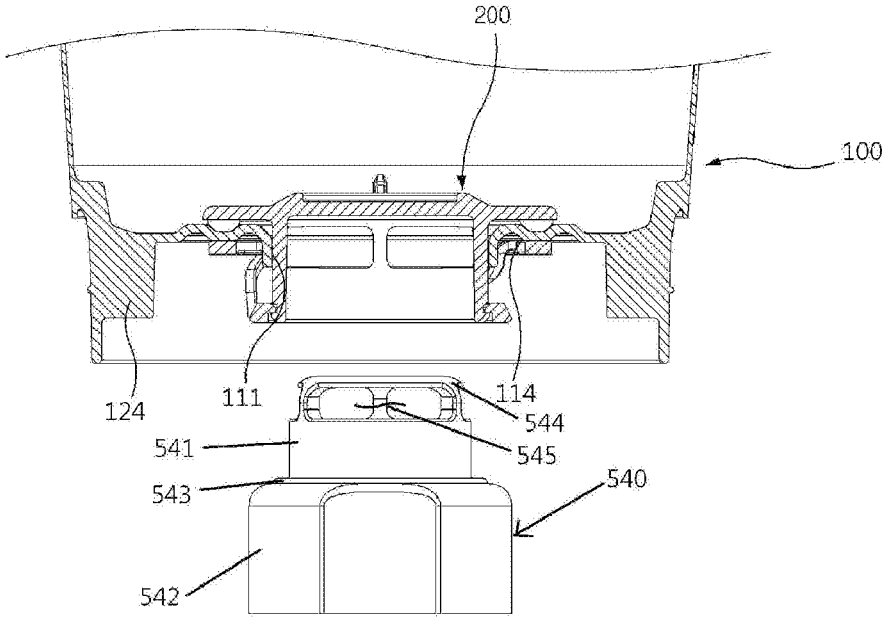
FIG. 12 is a cross-sectional view showing a process in which the beverage container according to the exemplary embodiment of the present invention is fitted to a nozzle of a beverage feeder.
Figure 13:
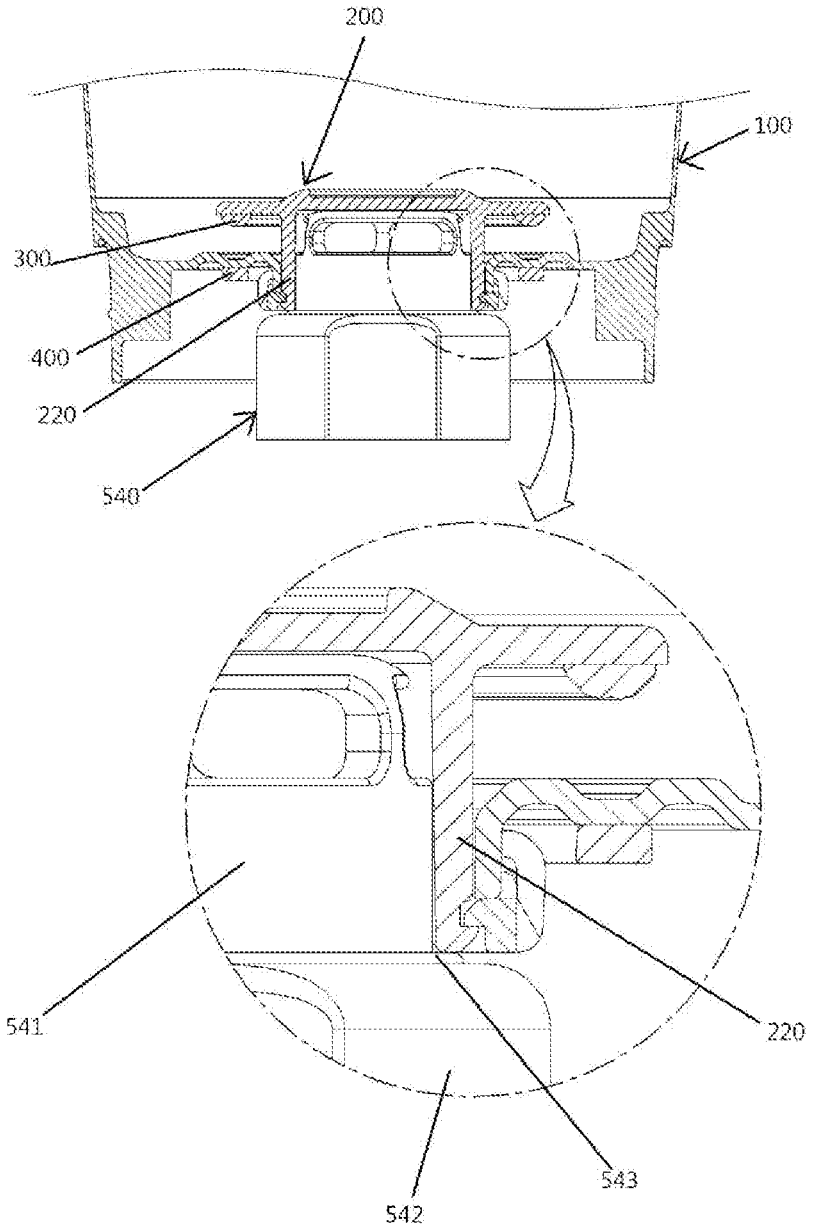
FIG. 13 is a cross-sectional view illustrating a use state in which a beverage is injected into the beverage container according to the exemplary embodiment of the present invention through the nozzle of the beverage feeder.
Figure 14:
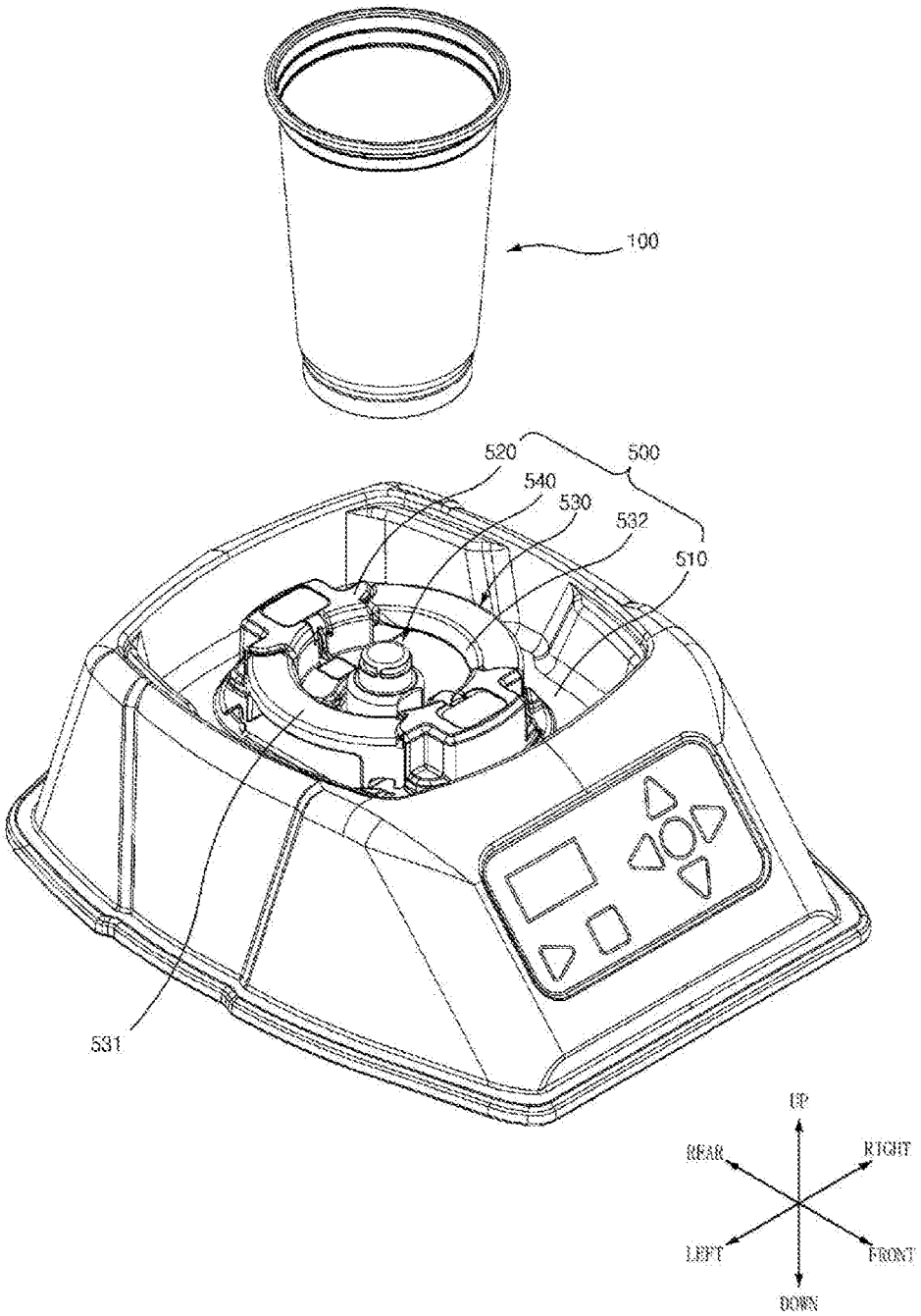
FIG. 14 is a perspective view illustrating the beverage feeder according to the exemplary embodiment of the present invention.
Figure 15:
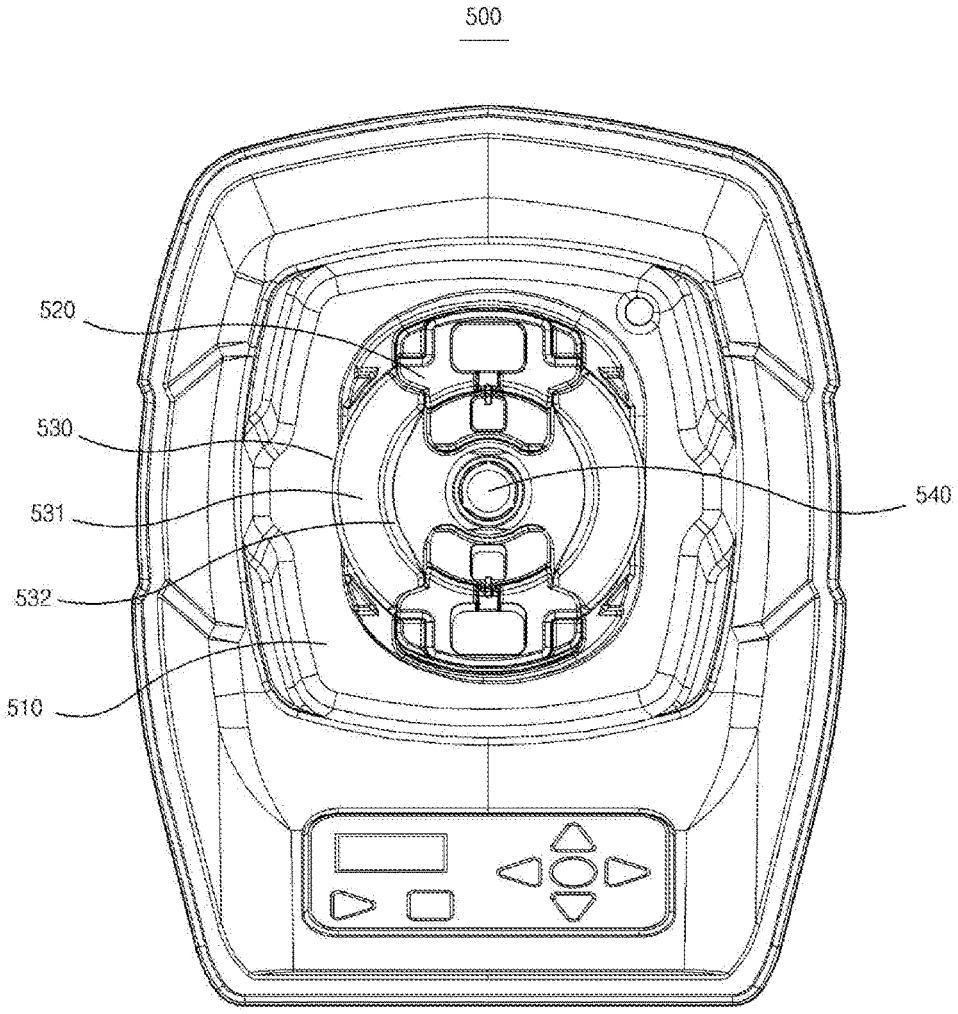
FIG. 15 is a plan view illustrating the beverage feeder according to the exemplary embodiment of the present invention.
Figure 16:
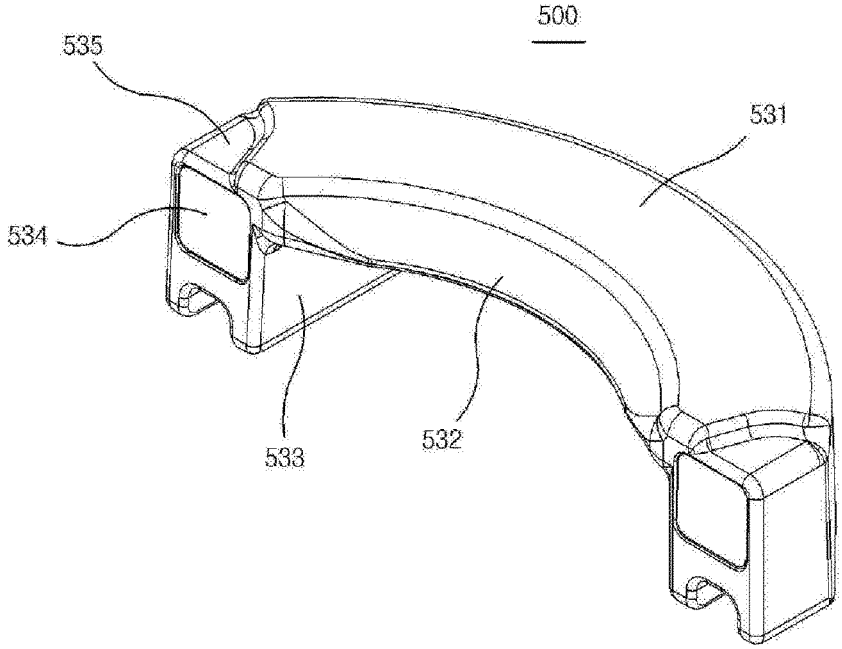
FIG. 16 is a perspective view illustrating a gripper of the beverage feeder according to the exemplary embodiment of the present invention.
Figure 17:
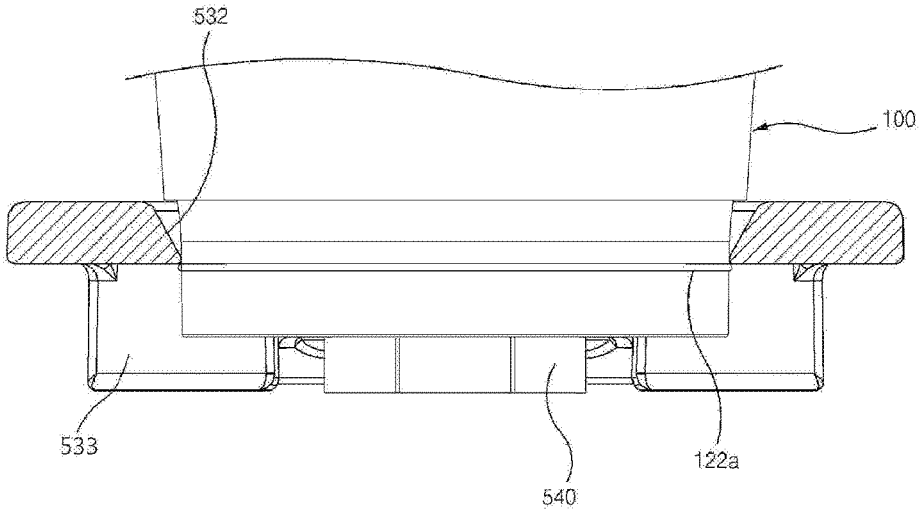
FIG. 17 is a view illustrating a state in which the beverage container is fitted into the beverage feeder according to the exemplary embodiment of the present invention.

As illustrated in FIGS. 5*a* and 5*b*, the holder 200 includes a cover part 210 configured to cover the inlet 111 and having a disc shape, and a holder sidewall part 220 formed below the cover part 210 and having a cylindrical shape.

The cover part 210 is laterally disposed and formed in a circular shape having a greater cross-sectional area than that of the inlet 111.

A cover protrusion part 211 protruding upward is formed on a central portion of the cover part 210.

The cover protrusion part 211 is formed to be tapered such that an outer diameter thereof decreases toward an upper portion thereof.

The maximum outer diameter of the cover protrusion part 211 is similar to or the same as that of the holder sidewall part 220.

A cover groove 212 having an open upper portion is formed at a central portion of the upper portion of the cover protrusion part 211.

The holder sidewall part 220 is inserted and vertically slid into the inlet 111, and an injection hole 221 is formed at an upper portion thereof in a circumferential direction. The injection hole 221 communicates with the accommodation part 101 when the inlet 111 is open.

The beverage container of the present embodiment may further include a packing member 300 interposed between the holder 200 and the bottom surface 110 in which the inlet 111 is formed in the container body 100.

The packing member 300 is formed in a ring shape.

An upper surface of a vertical cross-section of the packing member 300 is flat, and a lower surface thereof is formed in a substantially semi-circular arc shape. Accordingly, the packing member 300 is formed such that a vertical cross-sectional area thereof decreases toward a lower portion thereof.

Micro-protrusions 301 are formed at a lower end of the packing member 300 along an entire circumference thereof.

Two micro-protrusions 301 are formed and disposed at inner and outer sides to be radially spaced apart from each other. Sealing is effectively performed due to the micro-protrusions 301 while at the same time the packing member 300 is prevented from being attached to the bottom surface 110, and thus the holder 200 may easily move up and down.

In the present embodiment, the flat upper surface of the packing member 300 is disposed on a lower surface of the cover part 210 of the holder 200.

In addition, a groove 114 into which the packing member 300 is inserted is formed in a ridge part 113 formed at the bottom surface 110.

The ridge part 113 is formed by a circumference of the inlet 111 upwardly protruding from the bottom surface 110.

The groove 114 is formed by a central portion of the ridge part 113 being recessed downward.

A circumferential portion configured to surround the inlet 111 is formed at an inner side end of the ridge part 113 and bent downward.

A locking member 400 includes a first member 410, a second member 430 disposed to be spaced apart from the first member 410, and elastic arms 420 configured to be elastically deformed and connect the first member 410 and the second member 430.

The first and second members 410 and 430 are formed in a ring shape, and the first and second members 410 and 430 are formed to have different diameters. In the present embodiment, the first member 410 is formed to have a greater diameter than that of the second member 430.

One of the first and second members 410 and 430 is coupled to the holder 200. In the present embodiment, the second member 430 disposed below the first member 410 is coupled to the holder 200.

The holder 200 and the locking member 400 are coupled by a hook.

First hook protrusions 230 are formed on a lower portion of the holder sidewall part 220 of the holder 200. Four first hook protrusions 230 are formed and connected to each other. Since a plurality of first hook protrusions 230 are connected to each other, durability of the holder 200 is further improved. A second hook protrusion insertion groove, which will be described below, into which a second hook protrusion 431 is inserted is formed in an outer circumferential surface of the holder sidewall part 220 of the holder 200 along an entire circumference thereof. The second hook protrusion insertion groove is disposed above the first hook protrusion 230.

The second hook protrusion 431 is formed inside the second member 430 to protrude. The second hook protrusion 431 is formed along an entire inner circumferential surface of the second member 430.

The second hook protrusion 431 is hooked to the first hook protrusion 230 to couple the holder 200 and the locking member 400.

An outer side surface of the second member 430 is formed to be tapered such that an outer diameter of the second member 430 increases toward a lower portion of the second member 430. Accordingly, the rigidity of the locking member 400 can be further improved.

The first member 410 is pressed against the lower portion of the bottom surface 110. Specifically, the first member 410 is disposed below the groove 112.

A plurality of elastic arms 420 are formed, and the plurality of elastic arms 420 are disposed in the circumferential direction.

Each of the elastic arms 420 includes a first portion 421 vertically formed, a second portion 422 formed to be obliquely bent from the first portion 421 in the circumferential direction, a third portion 423 formed to be outwardly bent from the second portion 422, and a fourth portion 424 formed to be bent from third portion 423 in the circumferential direction.

The first portion 421 is formed outside the second member 430.

The second portion 422 and the fourth portion 424 are formed to be bent in opposite directions.

The fourth portion 424 is formed by cutting one portion of the first member 410.

In addition, the accommodation groove 114 accommodating the elastic arms 420 when the elastic arms 420 are folded may be formed in the container body 100.

Specifically, the accommodation groove 114 is formed in the lower portion of the bottom surface 110 to be interposed between the circumferential portion and the groove 112.

A method of manufacturing the container body 100 of the beverage container of the present embodiment having the above-described configuration will be described below.

The method includes a first molding operation in which the bottom surface 110, in which the inlet 111 is formed, and the container body 100, which includes the sidewall 120 configured to surround the bottom surface 110, are integrally injection molded, and a second molding operation in which the stopping protrusion 122*a* configured to be hooked to the beverage injector 500 is formed on an outer circumferential surface of the second sidewall 122 of the sidewall 120 through a hot-melt method. Accordingly, the stopping protrusion 122*a* may be easily formed.

A method of assembling the beverage container of the present embodiment having the above-described configuration will be described below.

The holder 200 in which the packing member 300 is installed is fitted into the inlet 111 of the container body 100 from above, the locking member 400 is pushed into the beverage container, the first hook protrusion 230 is hooked to the second hook protrusion 431, and thus the assembly is completed. As described above, the assembly can be simply and easily completed. In addition, when the locking member 400 is pushed into the beverage container, since the diameter of the first member 410 is greater than that of the second member 430, the locking member 400 may be easily inserted into the beverage container.

The nozzle 540 of the beverage feeder 500 of the present embodiment is formed in a cylindrical shape having a closed upper portion. The nozzle 540 is inserted into the holder sidewall part 220 of the holder 200.

Discharge parts 545 are formed at an upper portion of the nozzle 540 by cutting the nozzle 540 in the circumferential direction. The plurality of discharge parts 545 (for example, three discharge parts 545) are provided, the plurality of discharge parts 545 are disposed to be spaced apart from each other in the circumferential direction. The discharge parts 545 configured to discharges a beverage communicate with the injection hole 221.

The nozzle 540 includes a diameter decreasing part 541 and a diameter increasing part 542 disposed below the diameter decreasing part 541.

An outer diameter of the diameter decreasing part 541 is less than that of the diameter increasing part 542.

A vertical length of the diameter decreasing part 541 is the same as, similar to, or less than that of the inner wall of the holder sidewall part 220.

The outer diameter of the diameter decreasing part 541 is slightly less than the inner diameter of the holder sidewall part 220.

The outer diameter of the diameter increasing part 542 is greater than the inner diameter of the holder sidewall part 220. Accordingly, when the nozzle 540 is fitted into the holder sidewall part 220, a lower surface of the holder sidewall part 220 is hooked to the diameter increasing part 542.

A tapered part 544 is formed in the diameter decreasing part 541, which is the upper portion of the nozzle 540, such that an outer diameter of the tapered part 544 decreases toward an upper portion of the tapered part 544.

The tapered part 544 is formed such that an edge of the upper portion thereof is formed to be round.

Since the nozzle 540 is formed as described above, the beverage container may be easily fitted to or separated from the nozzle 540 even in a case in which the beverage container is not vertically oriented but is slightly tilted.

A sealing member 543 is installed on an outer circumferential surface of the nozzle 540. The sealing member 543 is formed as an O-ring.

The sealing member 543 is disposed below the discharge part 545 of the nozzle 540.

The sealing member 543 is interposed between the diameter decreasing part 541 and the diameter increasing part 542. That is, the sealing member 543 is disposed outside a lower end of the diameter decreasing part 541 and disposed above the diameter increasing part 542. Accordingly, the sealing member 543 may be stably installed.

As described above, the sealing member 543 is installed and disposed at a portion to which the lower surface of the holder sidewall part 220 is hooked when the nozzle 540 is completely inserted into the holder sidewall part 220.

Since the sealing member 543 is disposed at a lower portion of the beverage container, the beverage container may be easily fitted to or separated from the nozzle 540 while at the same time sealing may also be effectively performed.

That is, the sealing member 543 is interposed between the lower portion of the beverage container and the nozzle 540 of the beverage feeder 500.

Since the sealing member 543 is disposed below the holder sidewall part 220 of the holder 200 of the beverage container, sealing may be more effectively performed.

As described-above, the sealing member 543 is interposed between the nozzle 540 and a surface (a lateral direction) perpendicular to a direction (a vertical) in which the beverage container is inserted among surfaces of the beverage container facing the nozzle.

The beverage feeder 500 of the present embodiment may further include grippers 530 disposed at circumferences of both sides of the nozzle 540, and a support 510 in which the nozzle 540 and the grippers 530 are installed.

The grippers 530 are installed on the support 510 by limit housings 520 fixedly installed on an upper surface of the support 510. Two limit housings 520 are formed and disposed between two grippers 530.

An upper surface 531 of each of the grippers 530 is formed in an arc shape.

A limit seating groove 535 is formed in each of the both sides of the upper surface 531 of the gripper 530. The limit seating groove 535 is formed by recessing one portion of an outer edge of each of both ends of the upper surface 531. One portion of each of the both sides of the limit housing 520 is seated in the limit seating groove 535.

Both ends of the gripper 530 are formed to protrude at a right angle and are inserted into grooves formed in the limit housing 520.

In addition, steel plates 534, which are magnets or are formed of a magnetic material, are attached to sidewalls of the both ends of the gripper 530. The steel plates 534 are attached to magnets (not shown) installed at surfaces facing the both ends of the gripper 530 in the limit housing 520.

A stopping step 532 to which the stopping protrusion 122*a* is hooked is formed inside the gripper 530.

The stopping step 532 is formed to be tapered such that an inner diameter thereof decreases toward a lower portion thereof. The stopping step 532 is formed inside a lower portion of the upper surface 531.

The stopping step 532 is formed to be bent in an arc shape, and an R value of a central portion is less than that of the end portion such that the beverage container is more easily separated from the nozzle when the beverage container is tilted and separated therefrom.

Support legs 533 are formed below the both ends of the gripper 530 to protrude downward. The support legs 533 are laterally formed.

Since the support legs 533 are formed in a rib shape, frictional resistance may be minimized.

The support legs 533 are disposed at both sides of the stopping steps 532. Accordingly, the stopping steps 532 are disposed to be spaced apart from an upper surface of the support 510.

Accordingly, the stopping groove into which the stopping protrusion 122*a* is inserted is interposed between the stopping step 532 of the gripper 530 and the support 510.

Hereinafter, an operation of the present invention having the above-described configuration will be described.

The beverage container is pushed downward into the beverage feeder 500 such that the nozzle 540 of the beverage feeder 500 is inserted into the holder sidewall part 220 of the beverage container. Because of this, the nozzle 540 is inserted into the holder sidewall part 220, and the sealing member 543 is disposed below the holder sidewall part 220. In addition, the stopping protrusion 122*a* of the beverage container is hooked to the stopping step 532 of the gripper 530. Accordingly, the sealing member 543 is compressed such that the nozzle 540 and the holder sidewall part 220 are elastically pressed against each other. Because of this, sealing between the nozzle 540 and the beverage container may be effectively performed.

In addition, the nozzle 540 is inserted into the holder sidewall part 220 of the holder 200, and the elastic arms 420 of the locking member 400 is elastically deformed and folded by the pressing of the nozzle 540. At the same time, the holder 200 and the packing member 300 moves upward. Because of this, the injection hole 221 communicates with the accommodation part 101. Accordingly, a beverage injected through the nozzle 540 is injected into the accommodation part 101 through the bottom surface 110.

When the beverage is completely injected into the beverage container and the beverage container is tilted and withdrawn from the beverage feeder, the stopping protrusion 122*a* is withdrawn from the stopping step 532 and the nozzle 540 is separated from the holder 200. Because of this, the elastic arms 420 are restored to an initial state thereof, and a distance from the first member 410 to the second member 420 increases. Accordingly, the holder 200 connected to the second member 420 moves downward. Because of this, the inlet 111 is closed by the cover part 210. In addition, since the holder 200 moves downward, the packing member 300 simultaneously moves downward therewith and the micro-protrusions 301 of the packing member 300 are inserted into the groove 112, and thus sealing is more effectively performed. Accordingly, a beverage accommodated in the accommodation part 101 does not leak to the outside through the inlet 111.

As described above, while the present invention has been described with reference to the exemplary embodiment, it may be changed or modified by those skilled in the art without departing from the spirit and scope of the present invention defined by appended claims.

The invention claimed is:

1. A beverage feeder assembly comprising:

a beverage container including a container body having an inlet formed in a bottom surface thereof, a holder installed at the inlet to be slidable on the container body and configured to open and close the inlet, and a locking member interposed between the holder and the container body and configured to elastically support the holder in a direction in which the inlet is closed, and wherein the holder includes a cover part having a disc shape configured to cover the inlet, a holder sidewall part formed below the cover part and having a cylindrical shape, and an injection hole formed at an upper portion of the holder sidewall part in a circumferential direction;

a beverage feeder including a nozzle for insertion into the inlet and a sealing member disposed below a discharge part of the nozzle and arranged to be interposed between the bottom surface of the container body and the beverage feeder; and wherein the nozzle includes a diameter decreasing part and a diameter increasing part disposed below the diameter decreasing part; and when the nozzle is completely inserted into the holder sidewall part, the sealing member is disposed such that the lower surface of the holder sidewall part presses against the sealing member.

2. The beverage feeder assembly of claim 1, wherein a tapered part is formed at an upper portion of the nozzle such that an outer diameter of the tapered part decreases toward an upper portion of the tapered part.

3. The beverage feeder assembly of claim 1, wherein an upper edge of the nozzle is formed to be round.

4. The beverage feeder assembly of claim 1, wherein the beverage feeder further includes grippers disposed at circumferences of both sides of the nozzle, and a stopping step, to which a stopping protrusion of the beverage container is hooked, formed inside the grippers, and wherein the stopping step is formed in an arc shape, and a radius value of a central portion of the stopping step is less than that of an end portion of the stopping step.

* * * * *